US005805182A

United States Patent [19]

Lee

[11] Patent Number: 5,805,182

[45] Date of Patent: Sep. 8, 1998

[54] METHOD AND APPARATUS FOR CLEANING NOZZLES IN AN INK JET PRINTER

[75] Inventor: Jae-Han Lee, Suwon, Rep. of Korea

[73] Assignee: SamSung Electronics Co., Ltd., Kyungki-do, Rep. of Korea

[21] Appl. No.: 608,246

[22] Filed: Feb. 28, 1996

[30] Foreign Application Priority Data

Mar. 4, 1995 [KR] Rep. of Korea ..... 4458/1995

[51] Int. Cl.[6] ..... B41J 2/165

[52] U.S. Cl. ..... 347/35; 347/22

[58] Field of Search ..... 347/22, 30, 33, 347/35

[56] References Cited

U.S. PATENT DOCUMENTS

| | | | |
|---|---|---|---|
| 3,925,788 | 12/1975 | Kashio | 347/35 |
| 4,050,078 | 9/1977 | Isayama et al. . | |
| 4,450,456 | 5/1984 | Jekel et al. . | |
| 4,500,894 | 2/1985 | Kimer . | |
| 4,967,204 | 10/1990 | Terasawa et al. . | |
| 5,117,505 | 5/1992 | Sugiura et al. . | |
| 5,329,293 | 7/1994 | Liker . | |
| 5,367,326 | 11/1994 | Pond et al. . | |
| 5,583,547 | 12/1996 | Gast et al. | 347/22 |
| 5,659,342 | 8/1997 | Lund et al. | 347/35 |
| 5,694,157 | 12/1997 | Ahlvin | 347/33 |

*Primary Examiner*—Stuart N. Hecker
*Attorney, Agent, or Firm*—Robert E. Bushnell, Esq.

[57] ABSTRACT

A method for cleaning nozzles in an ink jet printer includes the steps of: ejecting ink from a first plurality of the nozzles that are not frequently used in printing every first period; and ejecting ink from a second plurality of the nozzles which are frequently used in printing every second period, wherein the first period is different from the second period.

21 Claims, 3 Drawing Sheets

METHOD AND APPARATUS FOR CLEANING NOZZLES IN AN INK JET PRINTER

CROSS-REFERENCE TO RELATED APPLICATIONS

This application makes reference to, incorporates the same herein, and claims all benefits accruing under 35 U.S.C. §119 arising from an application for Method And Apparatus For Cleaning Nozzles In An Ink Jet Printer earlier filed in the Korean Industrial Property Office on 4 Mar. 1995 and there duly assigned Ser. No. 4458/1995.

BACKGROUND OF THE INVENTION

The present invention relates to a method and apparatus for cleaning nozzles in an ink jet printer, and more particularly, to an economical method and apparatus for cleaning nozzles in an ink jet printer capable of reducing unnecessary ink consumption.

In a conventional ink jet printer, in order to prevent the nozzles of a head from clogging, all nozzles are cleaned together by forcing ink through the nozzles to discharge ink after each lapse of a predetermined time period during non-printing operation, or after each lapse of a printing operation period for a predetermined number of lines or pages. The mechanical construction and operation for cleaning nozzles are discussed in U.S. Pat. No. 4,967,204 issued Oct. 30, 1990.

With conventional ink jet printers, however, all nozzles are cleaned together even though only the nozzles which are not used in printing need to be actually cleaned. This results in unnecessary ink consumption; thus reducing the expected life span of an ink cartridge. In the case where the number of nozzles in an ink jet head is sixty-four, only forty-eight nozzles are used in printing general characters, and the remaining sixteen nozzles are scarcely used in printing. That is, only a portion of all nozzles are used in printing general characters. Therefore, with conventional nozzle cleaning techniques, since nozzle cleaning is performed by ejecting ink from all of the nozzles, a large quantity of waste ink is produced. Accordingly, the size of a cartridge for storing waste ink must be large, and the life span of the ink cartridge is reduced.

SUMMARY OF THE INVENTION

It is therefore an object of the present invention to provide an improved method and apparatus for cleaning nozzles in an ink jet printer.

It is another object to provide a method and apparatus for cleaning nozzles in an ink jet printer capable of reducing unnecessary ink consumption.

It is still another object to provide a method and apparatus for cleaning nozzles in an ink jet printer by classifying the nozzles into different groups, and cleaning the different groups of nozzles according to respective cleaning periods.

It is yet another object to provide a method and apparatus for cleaning nozzles in an ink jet printer by classifying the nozzles according to frequency of use in printing, and cleaning those nozzles which are used frequently according to a different period than those nozzles which are not used frequently.

These and other objects can be achieved in accordance with the principles of the present invention with a method for cleaning nozzles in an ink jet printer comprising the steps of: ejecting ink from a first plurality of the nozzles that are not frequently used in printing every first period; and ejecting ink from a second plurality of the nozzles which are frequently used in printing every second period, wherein the first period is different from the second period.

These and other objects can also be achieved in accordance with the principles of the present invention with an apparatus for cleaning nozzles in an ink jet printer. The apparatus includes a nozzle cleaner for cleaning a first plurality of the nozzles and a second plurality of the nozzles in response to a first nozzle cleaning signal and a second nozzle cleaning signal, respectively. A counter is provided and begins a counting operation in response to a count start signal. A central processing unit (CPU) generates the count start signal for transmission to the counter in response to a print command received from a computer. The central processing unit (CPU) generates the first nozzle cleaning signal for transmission to the nozzle cleaner when a value counted by the counter corresponds to a first cleaning period, and generates the second nozzle cleaning signal for transmission to the nozzle cleaner when the value counted by the counter corresponds to a second cleaning period.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

In the following description, specific details, such as the duration of a first period and a second period, are set forth to provide a more thorough understanding of the present invention. It will be intuitive to those skilled in the art, however, that the present invention may be practiced without these specific details.

In a preferred embodiment of the present invention, the nozzles of an ink jet printer are divided into groups, and the groups of nozzles are cleaned according to their frequencies of use. With a general character, a font is comprised of 36×48 (width×length) dots. In a head comprised of 64 nozzles, about 48 nozzles are frequently used in printing characters, and the remaining 16 nozzles are scarcely used. According to the preferred embodiment of the present invention, all of the 64 nozzles are not cleaned together. Rather, the 64 nozzles are divided into two groups (i.e., a first group of nozzles that are not frequently used in printing, and a second group of nozzles that are frequently used in printing), and the two groups of nozzles are cleaned by forcing ink through the nozzles according to respective cleaning periods.

Figure 1:
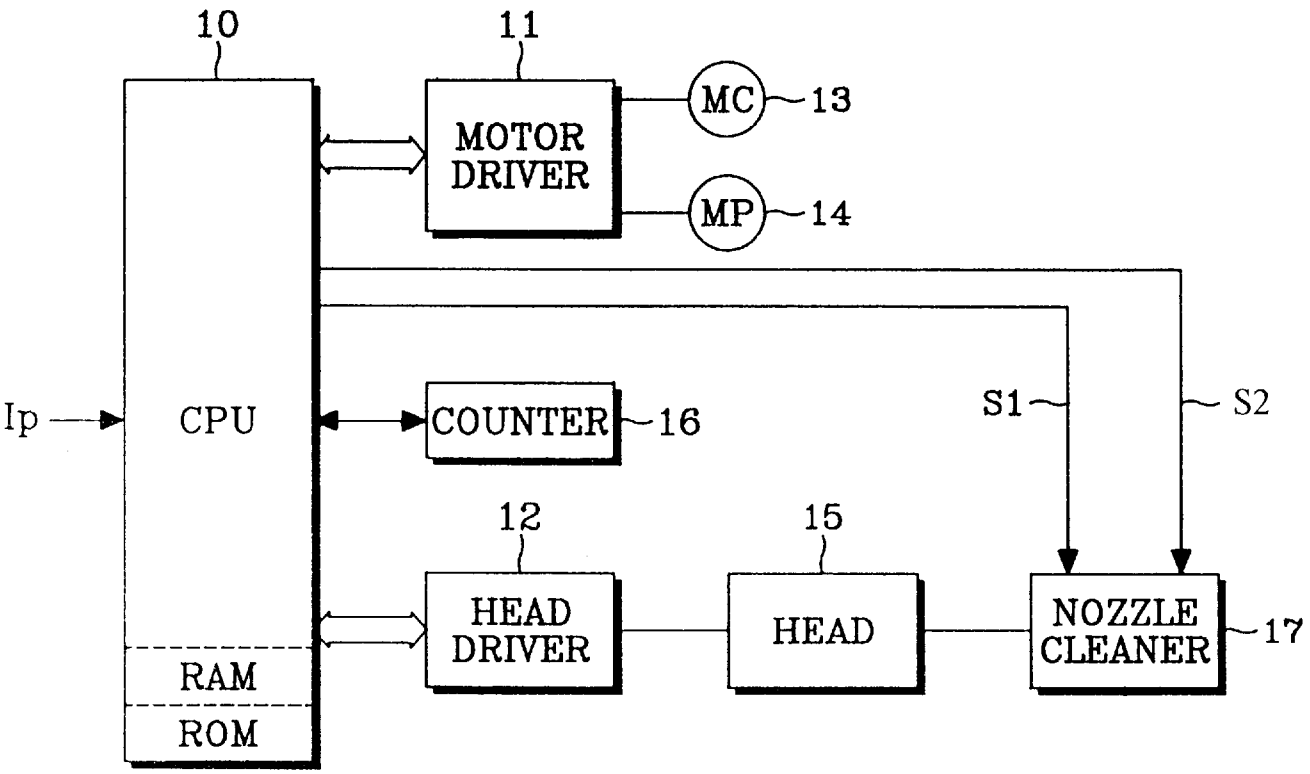
FIG. 1 is a diagram illustrating an apparatus for cleaning nozzles in an ink jet printer according to the principles of the present invention.

FIG. 1 is a diagram illustrating an apparatus for cleaning nozzles in an ink jet printer according to the principles of the present invention. The apparatus of FIG. 1 includes a nozzle cleaner 17 that cleans specific nozzles according to first and second nozzle group cleaning signals S1 and S2 by forcing ink through the nozzles. A counter 16 counts time according to a predetermined control signal. A central processing unit (CPU) 10 includes a read only memory (ROM) for storing a program for executing the present invention, and a random access memory (RAM) for storing data generated when performing the program stored in the read only memory (ROM). In response to a print command I from a computer, central processing unit (CPU) 10 generates a count start signal for transmission to counter 16 to thereby begin a counting operation. When a value counted by counter 16 corresponds to a first cleaning period T1, central processing unit (CPU) 10, which stores data regarding the first cleaning period T1, generates the first nozzle group cleaning signal S1 for transmission to nozzle cleaner 17. Also, when a value counted by counter 16 corresponds to a second cleaning period T2, central processing unit (CPU) 10, which stores data regarding the second cleaning period T2, generates the second nozzle group cleaning signal S2 for transmission to nozzle cleaner 17. The apparatus of FIG. 1 further includes: a motor driver 11, a head driver 12, a carriage motor (MC) 13, a paper feed motor (MP) 14, and a head 15 that contains the nozzles.

Figure 2:
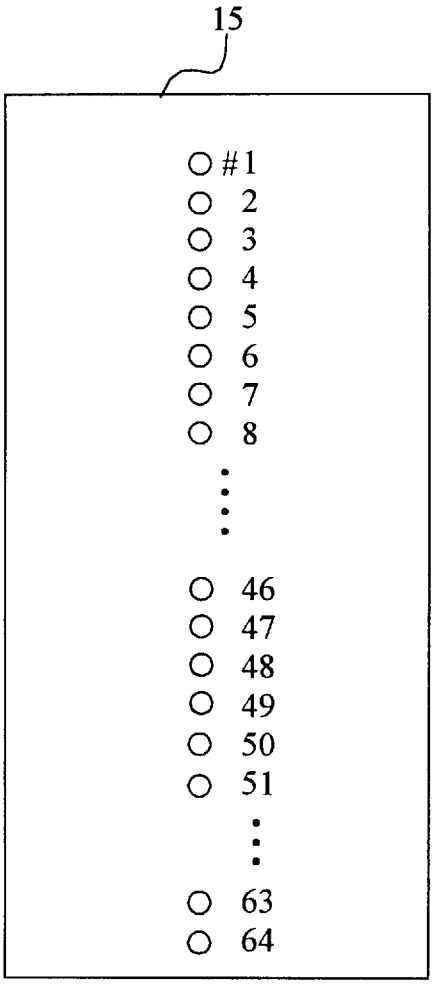
FIG. 2 is a diagram illustrating a nozzle configuration according to a first embodiment of the present invention.
Figure 3:
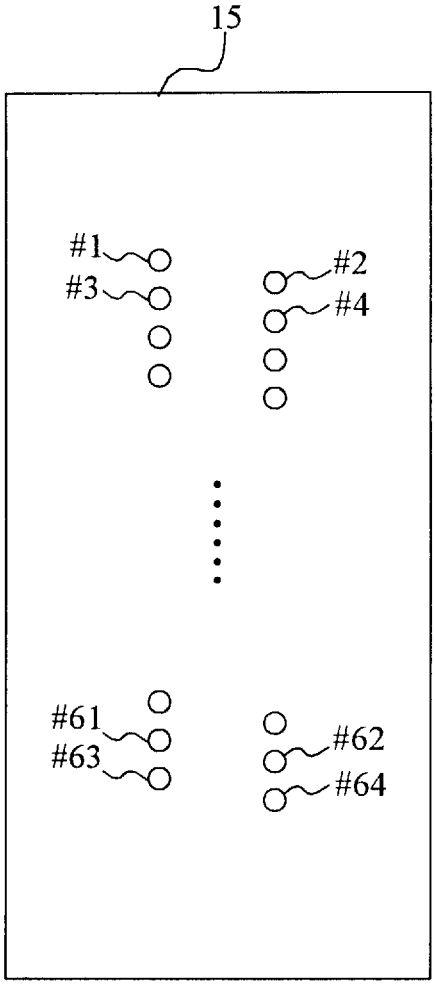
FIG. 3 is a diagram illustrating a nozzle configuration according to a second embodiment of the present invention.

Referring now to FIGS. 2 and 3, diagrams illustrating nozzle configurations of head 15 according to first and second embodiments of the present invention are respectively shown. According to the first embodiment shown in FIG. 2, the 64 nozzles of head 15 are sequentially arranged in a vertical pattern. According to the second embodiment shown in FIG. 3, the 64 nozzles of head 15 are sequentially arranged in a zigzag pattern.

Figure 4:
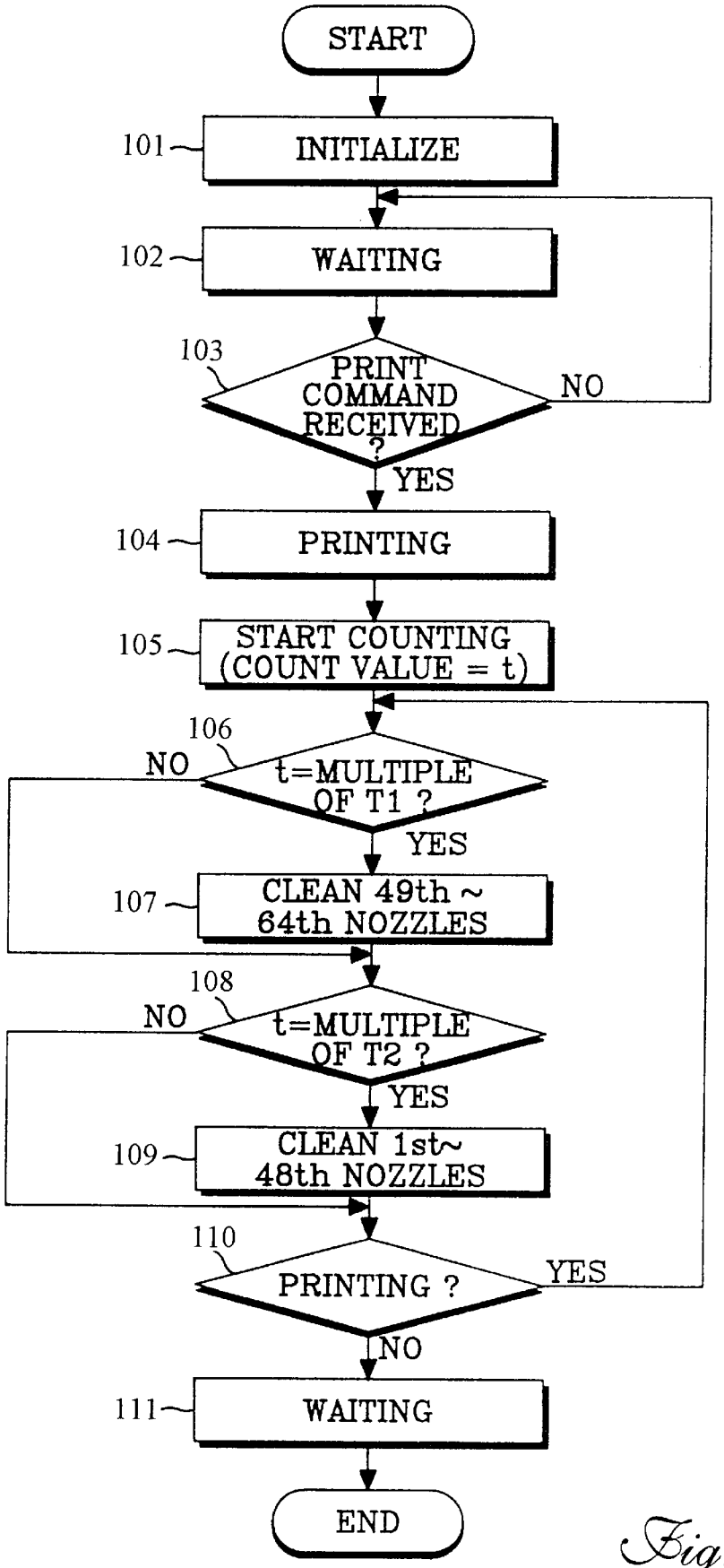
FIG. 4 is a flow chart illustrating a method for cleaning nozzles in an ink jet printer according to the principles of the present invention.

Referring now to FIG. 4, a flow chart illustrating a method for cleaning nozzles in an ink jet printer according to the principles of the present invention is shown. The method of FIG. 4 will now be described. In the following description, assume that head 15 is composed of 64 nozzles, as indicated in the embodiments shown in FIGS. 2 and 3.

Upon application of electrical power to the ink jet printer, an initialization operation is performed in step 101, and then a waiting state is entered in step 102. Next, in step 103, central processing unit (CPU) 10 determines whether the print command $I_f$ has been received from a computer. When the print command $I_f$ has not been received, the printer remains in the waiting state and continues to detect reception of the print command $I_f$. Once the print command $I_f$ has been received in step 103, the printer begins the printing operation in step 104. Upon printing, counter 16 starts counting in step 105, and maintains a count value represented as t. In step 106, central processing unit (CPU) 10 determines whether the count value t corresponds to a multiple of a first period T1. If the printing operation has just been started, the count value t may not correspond to the first period T1, and step 108 is accordingly performed. In step 108, central processing unit (CPU) 10 determines whether the count value t corresponds to a multiple of a second period T2. Since the printer is presumably still at the beginning of the printing operation, the count value t probably does not correspond to a multiple of the second period T2 and step 110 is accordingly performed. In step 110, a determination is made as to whether the printing operation is still being performed. If the amount of data being printed is relatively small, the printing operation may have been completed, and the waiting state is accordingly entered in step 111. However, since the printing operation continues in normal cases, the printer typically returns to step 106.

Once the count value t becomes equal to a multiple of the first period T1 after repeating the above steps, central processing unit (CPU) 10 generates first nozzle group cleaning signal S1 for transmission to nozzle cleaner 17, thereby cleaning the first group of nozzles that are not frequently used (i.e., the 49th to 64th nozzles) in step 107. If the count value becomes equal to a multiple of the second period T2, central processing unit (CPU) 10 generates second nozzle group cleaning signal S2 for transmission to nozzle cleaner 17, thereby cleaning the second group of nozzles that are frequently used (i.e., the 1st to 48th nozzles) in step 109.

Although the above description specifies that the two groups of nozzles are cleaned according to their respective cleaning periods, there may be instances where the two groups of nozzles are cleaned simultaneously. For example, assuming that the first period T1 is represented by a count value of 100 and the second period T2 is represented by a count value of 200, all nozzles are simultaneously cleaned every second period. Moreover, it is also possible to independently detect the two cleaning periods by using two counters, or to make the point of time of counting regarding the two respective periods different from each other.

As described above, the present invention is capable of reducing unnecessary ink consumption by dividing the nozzles to be cleaned and the cleaning periods according to their frequencies of use in printing. In particular, the cleaning period for those nozzles that are frequently used is longer than the cleaning period for those nozzles that are not frequently used.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A method for cleaning nozzles in an ink jet printer, comprising the steps of:

ejecting ink from a first plurality of said nozzles in said ink jet printer every first period; and ejecting ink from a second plurality of said nozzles in said ink jet printer every second period, said first period being different from said second period.

2. The method as claimed in claim 1, wherein said first plurality of said nozzles comprises a forty-ninth nozzle through a sixty-fourth nozzle.

3. The method as claimed in claim 2, wherein said second plurality of said nozzles comprises a first nozzle through a forty-eighth nozzle.

4. The method as claimed in claim 3, wherein said first nozzle through said sixty-fourth nozzle are sequentially arranged according to a zigzag pattern.

5. The method as claimed in claim 3, wherein said first nozzle through said sixty-fourth nozzle are sequentially arranged according to a vertical pattern.

6. The method as claimed in claim 1, wherein said second plurality of said nozzles comprises a first nozzle through a forty-eighth nozzle.

7. The method as claimed in claim 1, wherein said first period is shorter in duration than said second period.

8. An apparatus for cleaning nozzles in an ink jet printer, said apparatus comprising:

nozzle cleaning means for cleaning a first plurality of said nozzles and a second plurality of said nozzles in response to a first nozzle cleaning signal and a second nozzle cleaning signal, respectively;

counting means for beginning a counting operation in response to a count start signal; and control means for generating said count start signal and transmitting said count start signal to said counting means in response to a print command received from a computer, said control means generating said first nozzle cleaning signal and transmitting said first nozzle cleaning signal to said nozzle cleaning means when a value counted by said counting means corresponds to a first cleaning period, and generating said second nozzle cleaning signal and transmitting said second nozzle cleaning signal to said nozzle cleaning means when said value counted by said counting means corresponds to a second cleaning period.

9. The apparatus as claimed in claim 8, wherein said first plurality of said nozzles comprises a forty-ninth nozzle through a sixty-fourth nozzle.

10. The apparatus as claimed in claim 9, wherein said second plurality of nozzles comprises a first nozzle through a forty-eighth nozzle.

11. The apparatus as claimed in claim 10, wherein said first nozzle through said sixty-fourth nozzle are sequentially arranged according to a vertical pattern.

12. The method as claimed in claim 10, wherein said first nozzle through said sixty-fourth nozzle are sequentially arranged according to a zigzag pattern.

13. The apparatus as claimed in claim 8, wherein said second plurality of nozzles comprises a first nozzle through a forty-eighth nozzle.

14. The apparatus as claimed in claim 8, wherein said first cleaning period is shorter in duration than said second cleaning period.

15. A method for cleaning nozzles in an ink jet printer, comprising the steps of:

beginning a counting operation in response to a print command;

determining whether a count value generated from said counting operation corresponds to a first cleaning period, and cleaning a first plurality of said nozzles when said count value corresponds to said first cleaning period; and determining whether said count value corresponds to a second cleaning period, and cleaning a second plurality of said nozzles when said count value corresponds to said second cleaning period.

16. The method as claimed in claim 15, wherein said first plurality of said nozzles comprises a forty-ninth nozzle through a sixty-fourth nozzle.

17. The method as claimed in claim 16, wherein said second plurality of said nozzles comprises a first nozzle through a forty-eighth nozzle.

18. The method as claimed in claim 17, wherein said first nozzle through said sixty-fourth nozzle are sequentially arranged according to a zigzag pattern.

19. The method as claimed in claim 17, wherein said first nozzle through said sixty-fourth nozzle are sequentially arranged according to a vertical pattern.

20. The method as claimed in claim 15, wherein said second plurality of said nozzles comprises a first nozzle through a forty-eighth nozzle.

21. The method as claimed in claim 15, wherein said first cleaning period is shorter in duration than said second cleaning period.

* * * * *